US009132528B2

(12) United States Patent
Ekanayake et al.

(10) Patent No.: US 9,132,528 B2
(45) Date of Patent: Sep. 15, 2015

(54) REFURBISHING SYSTEM

(71) Applicant: General Electric Company, Schenectady, NY (US)

(72) Inventors: Sanji Ekanayake, Mableton, GA (US); Jon Conrad Schaeffer, Simpsonville, SC (US); Surinder Singh Pabla, Greer, SC (US); Alston Ilford Scipio, Mableton, GA (US); Ishmael Dean-El, Atlanta, GA (US)

(73) Assignee: General Electric Company, Schenectady, NY (US)

( * ) Notice: Subject to any disclaimer, the term of this patent is extended or adjusted under 35 U.S.C. 154(b) by 107 days.

(21) Appl. No.: 14/048,094

(22) Filed: Oct. 8, 2013

(65) Prior Publication Data

US 2015/0099429 A1 Apr. 9, 2015

(51) Int. Cl.
*B24C 3/32* (2006.01)
*B24C 9/00* (2006.01)

(52) U.S. Cl.
CPC .... *B24C 3/32* (2013.01); *B24C 9/00* (2013.01)

(58) Field of Classification Search
CPC ..... B24C 3/06; B24C 3/062; B24C 3/067; B24C 3/32; B24C 9/00; B24C 9/003; B24B 31/006
USPC ..... 451/36
See application file for complete search history.

(56) References Cited

U.S. PATENT DOCUMENTS 3,802,128 A 4/1974 Minear, Jr. et al.
3,634,973 A 3/1983 McCarty
3,521,412 A 5/1983 McCarty
4,790,544 A 12/1988 Kemp
4,996,796 A 3/1991 Rhoades
5,076,027 A 12/1991 Rhoades
5,125,191 A 6/1992 Rhoades
5,788,558 A 8/1998 Klein
5,827,114 A * 10/1998 Yam et al. ..... 451/75
5,902,174 A * 5/1999 Jono ..... 451/92
6,029,977 A 2/2000 Sym
6,273,787 B1 8/2001 Gilmore et al.
6,280,295 B1 8/2001 Wu
6,280,303 B1 8/2001 Kawasaki
6,500,050 B2 12/2002 Walch et al.
6,544,110 B2 4/2003 Gilmore et al.
6,729,937 B2 5/2004 Kawasaki
6,780,089 B2 8/2004 Pan et al.
6,883,527 B2 4/2005 Travaly et al.
6,918,937 B2 7/2005 Gilmore et al.
7,118,464 B2 10/2006 Bolz et al.
7,665,338 B2 * 2/2010 Cheppe et al. ..... 72/53
7,753,760 B2 7/2010 Petrosky

FOREIGN PATENT DOCUMENTS

WO WO 9517994 A1 * 7/1995

* cited by examiner

*Primary Examiner* — Monica Carter
*Assistant Examiner* — Lauren Beronja

(57) ABSTRACT

A system for refurbishing at least one article attached to an assembly includes a refurbishing vessel that contains at least one wall and at least one open portion; means for providing an abrasive media to the vessel, wherein the abrasive media is caused to flow around the surfaces of the at least one article when the vessel is positioned on the at least one article; means for conformably sealing the at least one open portion against the flow of abrasive media, wherein a seal is created that conforms to the contours of the at least one article and prevents the abrasive media from escaping between the at least one article and the at least one wall; and means for removing the abrasive media from the vessel.

22 Claims, 3 Drawing Sheets

REFURBISHING SYSTEM

BACKGROUND OF THE INVENTION

The field of the invention relates generally to refurbishing gas turbine airfoil components. More specifically, the present invention is directed to systems and methods for polishing the surfaces of gas turbine airfoil components using abrasive media.

In a gas turbine, air pressurized in a compressor section is mixed with fuel and ignited to generate hot pressurized gases. The hot pressurized gases pass through a turbine section that converts the thermal and kinetic energy from the hot pressurized gases to mechanical torque acting on a rotating shaft or other element, thereby producing power used for both compressing the incoming air and driving an external load, such as an electric generator. As used herein, the term "gas turbine" may encompass stationary or mobile turbomachines, and may have any suitable arrangement that causes rotation of one or more shafts.

The air entering the gas turbine often contains gaseous, liquid and particulate matter that pass through the compressor section and degrade the surface finish of the rotating and stationary compressor airfoils. These and other contaminants may then be entrained in the hot pressurized gases that pass through the turbine section, which, along with the effects of heat and oxidation, similarly degrade the surface finish of the rotating and stationary turbine airfoils.

The effect of this degradation over time, particularly in the compressor section, is reduced gas turbine output and efficiency due to reduced aerodynamic performance of the airfoils. Current practice of refurbishing the airfoils typically includes manual polishing of the airfoil surfaces during planned maintenance periods, such as when the turbine rotor is removed during a major inspection. However, the manual polishing is time consuming and does not restore the surface finish to an as new condition.

In view of the above, there is a desire for improved systems and methods for restoring the surface finish of gas turbine airfoils during maintenance periods.

BRIEF DESCRIPTION OF THE INVENTION

Embodiments of the present invention are summarized below. These embodiments are not intended to limit the scope of the claimed invention, but rather, these embodiments are intended only to provide a brief summary of possible forms of the invention. Furthermore, the invention may encompass a variety of forms that may be similar to or different from the embodiments set forth below, commensurate with the scope of the claims.

According to a first embodiment of the present invention, a system for refurbishing at least one article attached to an assembly, wherein the assembly is a portion of a turbomachine, includes a refurbishing vessel that contains at least one wall and at least one open portion; means for providing an abrasive media to the vessel, wherein the abrasive media is caused to flow around the surfaces of the at least one article when the vessel is positioned on the at least one article; means for conformably sealing the at least one open portion against the flow of abrasive media, wherein a seal is created that conforms to the contours of the at least one article and prevents the abrasive media from escaping between the at least one article and the at least one wall; and means for removing the abrasive media from the vessel.

According to a second embodiment of the present invention, a method for refurbishing at least one article includes providing access to the at least one article while attached to an assembly, wherein the assembly is a portion of a turbomachine; providing a refurbishing system that includes a refurbishing vessel that contains at least one wall and at least one open portion; means for providing an abrasive media to the vessel, wherein the abrasive media is caused to flow around the surfaces of the at least one article when the vessel is positioned on the at least one article; means for conformably sealing the at least one open portion against the flow of abrasive media, wherein a seal is created that conforms to the contours of the at least one article and prevents the abrasive media from escaping between the at least one article and the at least one wall; and means for removing the abrasive media from the vessel; positioning the refurbishing vessel on the at least one article; sealing the at least one open portion, wherein a seal is created that conforms to the contours of the at least one article; providing the abrasive media to the vessel and flowing the abrasive media around the surfaces of the at least one article; removing the abrasive media from the vessel; and removing the refurbishing vessel from the at least one article.

BRIEF DESCRIPTION OF THE DRAWINGS

These and other features, aspects and advantages of the present invention may become better understood when the following detailed description is read with reference to the accompanying figures (FIGS.), wherein like reference numerals refer to like parts throughout the various views unless otherwise specified.

DETAILED DESCRIPTION OF THE INVENTION

Specific embodiments of the present invention are described below. This written description, when read with reference to the accompanying figures, provides sufficient detail to enable a person having ordinary skill in the art to practice the invention, including making and using any devices or systems and performing any incorporated methods. However, in an effort to provide a concise description of these embodiments, every feature of an actual implementation may not be described in the specification, and embodiments of the present invention may be employed in combination or embodied in alternate forms and should not be construed as limited to only the embodiments set forth herein. The scope of the invention is, therefore, indicated and limited only by the claims, and may include other embodiments that may occur to those skilled in the art.

The terminology used herein is for describing particular embodiments only and is not intended to be limiting of example embodiments. As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

Similarly, the terms "comprises", "comprising", "includes" and/or "including", when used herein, specify the presence of stated features, integers, steps, operations, elements, and/or components, but do not preclude the presence or addition of one or more other features, integers, steps, operations, elements, components, and/or groups thereof. As used herein, the term "and/or" includes any, and all, combinations of one or more of the associated listed items.

Certain terminology may be used herein for the convenience of the reader only and is not to be taken as a limitation on the scope of the invention. For example, words such as "upper", "lower", "left", "right", "front", "rear", "top", "bottom", "horizontal", "vertical", "upstream", "downstream", "fore", "aft", and the like, when used without further limitation, merely describe the specific configuration illustrated in the various views. Similarly, the terms "first", "second", "primary", "secondary", and the like, when used without further limitation, are only used to distinguish one element from another and do not limit the elements described.

Figure 1:
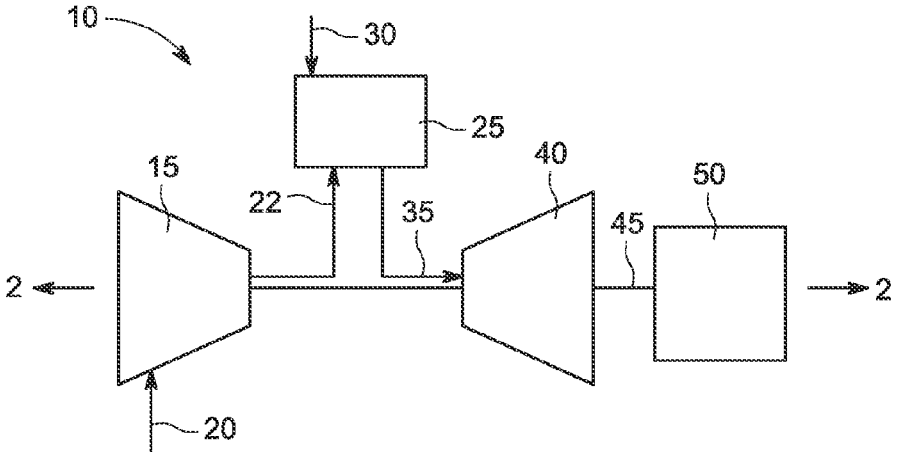
FIG. 1 is a schematic illustration of an exemplary gas turbine system in which embodiments of the present invention may operate.

Referring now to the figures (FIGS.), wherein like reference numerals refer to like parts throughout the various views unless otherwise specified, FIG. 1 illustrates an exemplary gas turbine system 10 in which embodiments of the present invention may operate. The gas turbine system 10 includes a compressor 15 that compresses an incoming flow of air 20. The compressed flow of air 22 is delivered to at least one combustor 25, in which the air is mixed with fuel 30 and ignited, producing a flow of hot pressurized gases 35. The flow of hot pressurized gases 35 is delivered to a turbine 40, in which the gases pass through one or more stationary and rotating turbine stages that convert the thermal and kinetic energy from the hot pressurized gases to mechanical torque acting on one or more rotating elements connected to a rotating shaft 45. An external load 50, such as a generator, is connected to the shaft 45, thereby converting the mechanical torque to electricity. The shaft 45 may also extend forward through the turbine 40 to drive the compressor 15, or a separate shaft (not illustrated) may be provided from the turbine 40 for that purpose.

Figure 2:
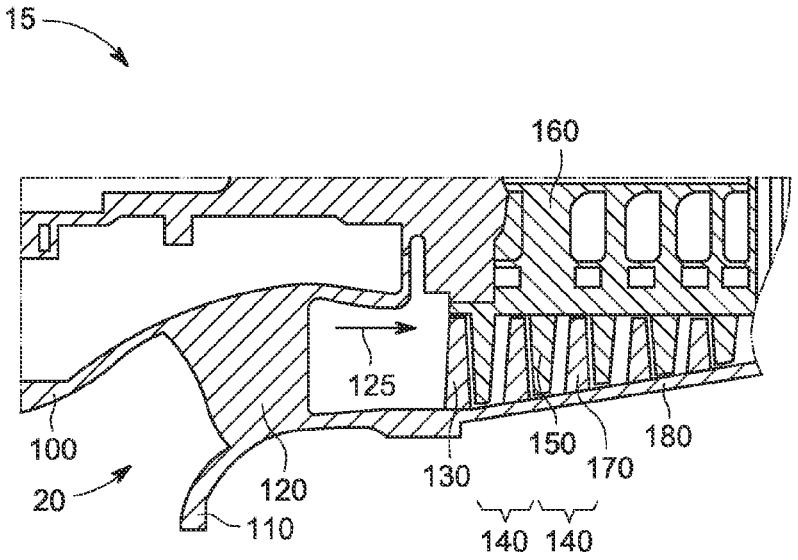
FIG. 2 is a partial cross-sectional view of the lower half of the compressor 15 of FIG. 1 viewed along the line 2-2.

FIG. 2 is a partial cross-sectional view of the lower half of the compressor 15 of FIG. 1 viewed along the line 2-2. The incoming air 20 enters through an annular passage disposed between an inner bellmouth 100 and an outer bellmouth 110. A plurality of circumferentially spaced struts 120 are radially disposed between the inner and outer bellmouths, which direct the air 20 toward the compressor inlet generally in the direction indicated by the arrow 125. The air then passes between a plurality of circumferentially adjacent steerable guide vanes 130 that direct the air into a first compressor stage 140, within which the air is partially compressed. The air is fully compressed by passing through successive compressor stages 140 arranged generally in the direction indicated by the arrow 125.

Each successive compressor stage 140 includes a plurality of circumferentially adjacent rotating airfoils 150 extending generally radially outwardly from a rotor 160, followed by a plurality of circumferentially adjacent stationary airfoils 170 extending generally radially inwardly from a casing 180. It is noted that the arrangement described above is typical of heavy duty gas turbines; but that other suitable arrangements of steerable guide vanes, rotating airfoils and stationary airfoils may be substituted for the embodiment shown while still falling within the meaning and scope of the claims.

Figure 3:
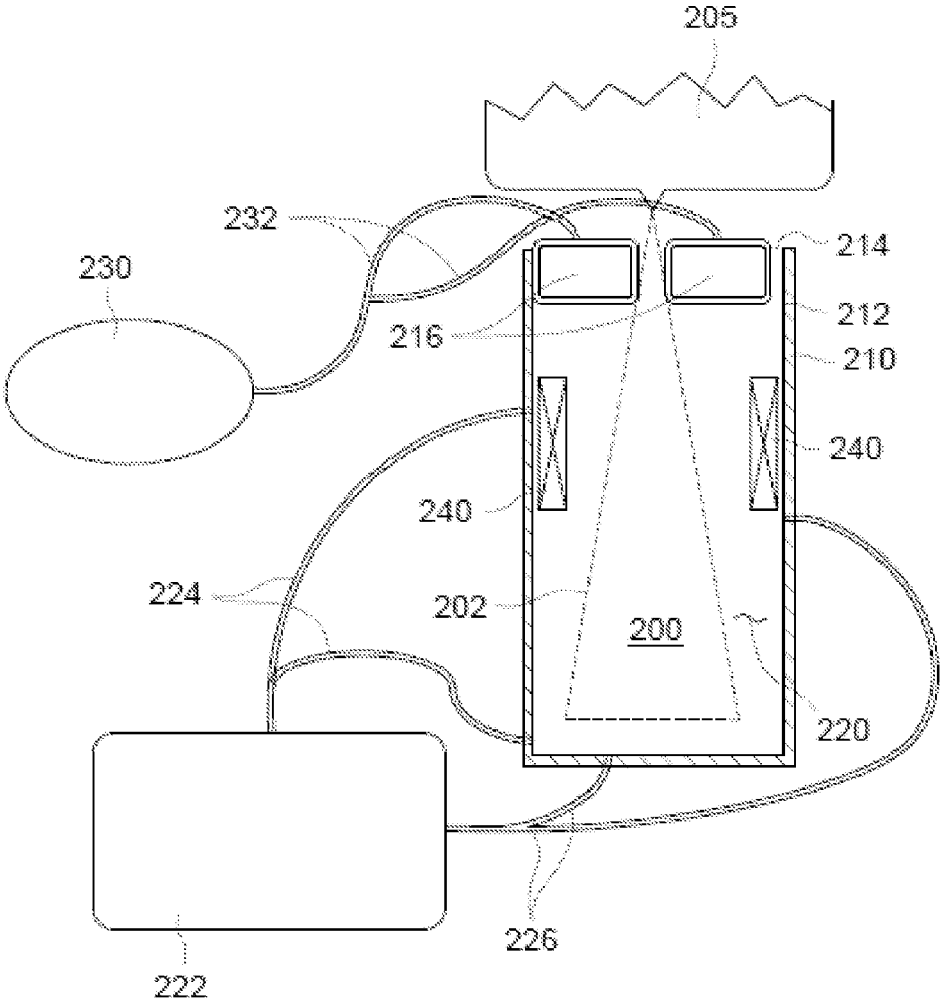
FIG. 3 is a cross-sectional view of a refurbishing system in accordance with aspects of the present invention.

FIG. 3 is a cross-sectional view of a refurbishing system in accordance with aspects of the present invention. At least one article 200 including at least one surface 202 to be refurbished is attached to an assembly 205; wherein the article 200 may be either a rotating airfoil 150 (FIG. 2) attached to a rotor assembly 160 (FIG. 2) or a stationary airfoil 170 (FIG. 2) attached to a casing assembly 180 (FIG. 2). Access to the article 200 may be provided, for example, by removing the top compressor casing (not illustrated), or by entering through a suitable opening in the compressor casing. A refurbishing vessel 210 having at least one wall 212 and at least one open portion 214 is positioned in such a manner as to substantially surround and encase the article 200, with the exception of the open portion 214, and at least one sealing element 216 is positioned substantially close to the interface between the article 200 and the assembly 205. The vessel may be of any suitable geometry; including cylindrical, rectangular, and the like; so long as the vessel substantially surrounds and encases the article and substantially fits into the available space between adjacent articles.

An abrasive media 220 is then provided to the vessel and caused to fill the space between the article 200 and the at least one wall 212. The abrasive media may be supplied from at least one supply tank 222 via at least one supply line 224, and may be returned to the supply tank or a separate return tank (not illustrated) via at least one return line 226. The abrasive media may be also be supplied through the open portion 214. Prior to completely filling the space with the abrasive media, the sealing element 216 is inflated with a fluid, thereby creating a seal that conforms to the contours of the article and prevents the abrasive media from escaping through the open portion 214. Any suitable fluid may be used to inflate the sealing element; including gases such as compressed air, nitrogen, or carbon dioxide; or liquids such as water, oil, or hydraulic fluid. The fluid may be supplied by a pump 230 via at least one tube 232, and may be removed by reversing the pump and evacuating the fluid through the tube or by using a vent or drain (not illustrated).

In an embodiment, the abrasive media is a viscoelastic slurry containing abrasive particles, such as 931-H Abrasive Flow Media (Extrude Hone Corporation). The slurry may be provided to the vessel and caused to flow around the surfaces of the article using at least one pump (not illustrated) located within or substantially close to the at least one supply tank 222. Preferably, the pump is a positive displacement type, which delivers a substantially constant volume of slurry (depending on the operating speed of the pump) over a wide range of slurry pressure and viscosity. Additionally, the pressure and flow of the slurry may be further controlled using known apparatus such as regulating valves and orifices. The slurry may also be provided to the vessel by providing a pressurized fluid, such as compressed air, to the supply tank. If more than one supply line 224 is used, at least one manifold (not illustrated) may be used to divide the flow of slurry among the supply lines. Depending on the complexity of the article surfaces to be abraded and degree of abrasion required, the slurry may be caused to flow in a single direction, multiple directions, or reversed in one or more directions using an appropriate number and arrangement of pumps, manifolds and supply lines. When the refurbishment of the article is substantially completed, the slurry may then be removed from the vessel by providing a pressurized fluid, such as compressed air, to the vessel via the at least one supply line 224, thereby causing the slurry to exit the vessel via the at least one return line 226.

In another embodiment, the abrasive media is a solid material in bead or pellet form, such as ceramic, plastic or synthetic mass finishing media (Vibra Finish Company). The solid material may be provided to the vessel and caused to flow around the surfaces of the article by providing a pressurized fluid, such as compressed air, to the supply tank 222 or by introducing the solid material through the open portion 214. The solid material may be energized using at least one exciter element 240 positioned substantially close or attached to the at least one wall 212, which causes sufficient relative motion between the solid material and the article to abrade the surfaces of the article. The exciter element may be any suitable material or apparatus that converts electrical energy to mechanical displacement, including magnetostrictive and piezoelectric materials, thereby producing an acoustic wave motion in the solid media. When the refurbishment of the article is substantially completed, the solid material may then be removed from the vessel through the open portion 214 or by providing a pressurized fluid, such as compressed air, to the vessel via the at least one supply line 224, thereby causing the solid material to exit the vessel via the at least one return line 226.

Figure 4:
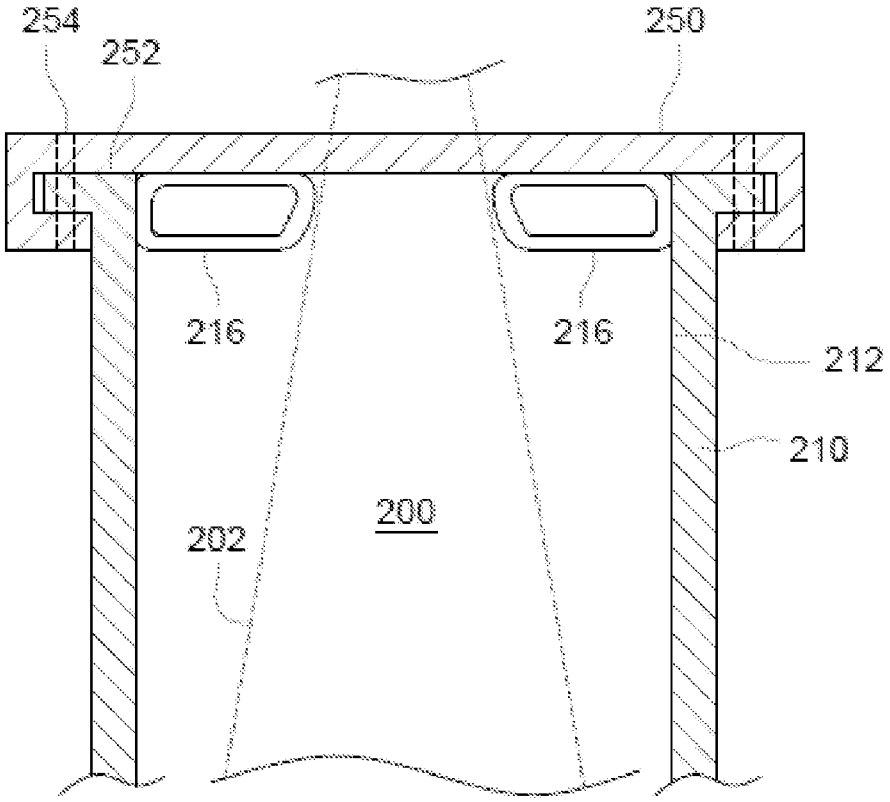
FIG. 4 is an expanded cross-sectional view of the refurbishing system of FIG. 3 in accordance with aspects of the present invention.

FIG. 4 is an expanded cross-sectional view of the refurbishing system of FIG. 3 in accordance with aspects of the present invention. A segmented support element 250 is positioned around the article 200 in such a manner as to substantially close the vessel 210 and prevent the article from moving during the refurbishing operation. The wall 212 may be formed as a flange 252 in the region that is substantially in contact with the support element. The support element may be rigidly affixed to the flange using at least one mechanical fastening element (not illustrated) that may be inserted through at least one guide hole 254 provided in the support element and flange, which increases the structural rigidity of the vessel and provides a surface against which the sealing element 216 may react as it conforms to the contours of the article 200.

As described above, the present invention contemplates systems and methods for restoring the surface finish of articles, such as gas turbine compressor airfoils, during maintenance periods when the gas turbine is partially disassembled to provide access to the articles while they remain attached to the gas turbine rotor or casing. The articles may be refurbished singly or in groups, and may be attached to a single stage or multiple stages.

Although specific embodiments are illustrated and described herein, including the best mode, those of ordinary skill in the art will appreciate that all additions, deletions and modifications to the embodiments as disclosed herein and which fall within the meaning and scope of the claims may be substituted for the specific embodiments shown. Similarly, other embodiments of the invention may be devised which do not depart from the spirit or scope of the present invention. Such other embodiments are intended to be within the scope of the claims if they have structural elements that do not differ from the literal language of the claims, or if they include equivalent structural elements with insubstantial differences from the literal languages of the claims. Likewise, the system components illustrated are not limited to the specific embodiments described herein, but rather, system components can be utilized independently and separately from other components described herein. For example, the components and assemblies described herein may be employed in any suitable type of gas turbine, aircraft engine, or other turbomachine having any suitable number and arrangement of stages, disks and shafts while still falling within the meaning and scope of the claims.

What is claimed is:

1. A system for refurbishing at least one article comprising at least one surface and attached to an assembly during refurbishing, wherein the assembly is a portion of a turbomachine, and further comprising:

a refurbishing vessel comprising at least one wall substantially surrounding and encasing the at least one article and at least one open portion defining a cavity between the at least one wall and the at least one surface;

means for providing an abrasive media to the cavity, wherein the abrasive media is caused to flow over and is confined in pressure contact with the at least one surface when the vessel is positioned about the at least one article;

means for conformably sealing the cavity against the flow of abrasive media, wherein a seal is created by inflating at least one sealing element with a fluid that conforms to contours of the at least one article and prevents the abrasive media from escaping between the at least one article and the at least one wall; and means for removing the abrasive media from the cavity.

2. The system of claim 1, wherein the abrasive media comprises a viscoelastic slurry containing abrasive particles.

3. The system of claim 1, wherein the abrasive media comprises a solid material in bead or pellet form, wherein the solid material is energized to abrade the at least one surface.

4. The system of claim 1, wherein the fluid is compressed air.

5. The system of claim 1, wherein the means for removing the abrasive media from the cavity is a flow of fluid.

6. The system of claim 5, wherein the fluid is compressed air.

7. The system of claim 2, wherein the means for providing the abrasive media to the cavity and flowing the abrasive media over and in pressure contact with the at least one surface is a positive displacement pump.

8. The system of claim 3, wherein the means for energizing the solid material is a magnetostrictive exciter element.

9. The system of claim 3, wherein the means for energizing the solid material is a piezoelectric exciter element.

10. A method for refurbishing at least one article, wherein the at least one article comprises at least one surface and is attached to an assembly during refurbishing, wherein the assembly is a portion of a turbomachine, comprising:

providing access to the at least one article;

providing a refurbishing system comprising:

a refurbishing vessel comprising at least one wall substantially surrounding and encasing the at least one article and at least one open portion defining a cavity between the at least one wall and the at least one surface;

means for providing an abrasive media to the cavity, wherein the abrasive media is caused to flow over and is confined in pressure contact with the at least one surface when the vessel is positioned about the at least one article;

means for conformably sealing the cavity against the flow of abrasive media, wherein a seal is created by inflating at least one sealing element with a fluid that conforms to contours of the at least one article and prevents the abrasive media from escaping between the at least one article and the at least one wall; and means for removing the abrasive media from the cavity;

positioning the refurbishing vessel about the at least one article;

sealing the cavity, wherein a seal is created that conforms to contours of the at least one article;

providing the abrasive media to the cavity and flowing the abrasive media over and in pressure contact with the at least one surface;

removing the abrasive media from the cavity; and removing the refurbishing vessel from the at least one article.

11. The method of claim 10, wherein the abrasive media comprises a viscoelastic slurry containing abrasive particles.

12. The method of claim 10, wherein the abrasive media comprises a solid material in bead or pellet form, wherein the solid material is energized to abrade the at least one surface.

13. The method of claim 10, wherein the fluid is compressed air.

14. The method of claim 10, wherein the means for removing the abrasive media from the cavity is a flow of fluid.

15. The method of claim 14, wherein the fluid is compressed air.

16. The method of claim 11, wherein the means for providing the abrasive media to the cavity and flowing the abrasive media over and in pressure contact with the at least one surface is a positive displacement pump.

17. The method of claim 12, wherein the means for energizing the solid material is a magnetostrictive exciter element.

18. The method of claim 12, wherein the means for energizing the solid material is a piezoelectric exciter element.

19. The system of claim 1, wherein the at least one article is a gas turbine compressor rotating airfoil and wherein the assembly is a gas turbine compressor rotor.

20. The system of claim 1, wherein the at least one article is a gas turbine compressor stationary airfoil and wherein the assembly is a gas turbine compressor casing.

21. The method of claim 10, wherein the at least one article is a gas turbine compressor rotating airfoil and wherein the assembly is a gas turbine compressor rotor.

22. The method of claim 10, wherein the at least one article is a gas turbine compressor stationary airfoil and wherein the assembly is a gas turbine compressor casing.

* * * * *